United States Patent [19]

Hall

[11] Patent Number: 4,727,793

[45] Date of Patent: Mar. 1, 1988

[54] SIGNAL VALVE FOR PRESSURE COMPENSATED SYSTEM

[75] Inventor: Lowell R. Hall, Elwood, Ill.

[73] Assignee: Caterpiller, Inc., Peoria, Ill.

[21] Appl. No.: 673,162

[22] Filed: Jan. 24, 1983

[30] Foreign Application Priority Data

Jan. 24, 1983 [WO] PCT Int'l Appl. ..... 83/00105

[51] Int. Cl.[4] ..... F15B 13/64

[52] U.S. Cl. ..... 91/451; 91/452; 91/468

[58] Field of Search ..... 91/449, 450, 451, 452, 91/462, 466, 468, DIG. 2, 461

[56] References Cited

U.S. PATENT DOCUMENTS

| | | | |
|---|---|---|---|
| 2,789,542 | 4/1957 | Vander Kaay | 91/451 |
| 3,025,717 | 3/1962 | Christenson | 91/451 |
| 3,088,283 | 5/1963 | Furia et al. | 91/451 |
| 3,411,416 | 11/1968 | Herd et al. | 91/451 |
| 3,948,146 | 4/1976 | Maurer et al. | 91/451 |
| 3,971,216 | 7/1976 | Miller | 60/445 |
| 4,163,412 | 8/1979 | Porter | 91/451 |
| 4,176,685 | 12/1979 | Hoefer et al. | 91/451 |
| 4,206,688 | 6/1980 | Haak et al. | 91/452 |

*Primary Examiner*—Deborah L. Kyle
*Assistant Examiner*—Richard L. Klein
*Attorney, Agent, or Firm*—John W. Grant

[57] ABSTRACT

A signal valve (38) is connected to a supply conduit (16) connecting a pump (11) with a control valve (14) for transmitting an artificial load signal to a load signal chamber (34) of a pressure compensated unloader valve (27) when the control valve is at an operating position and the pressure in the supply conduit (16) is below a preselected value. This moves a valve member (31) of the unloader valve (27) to a blocking position causing essentially full pump flow to be directed to the hydraulic jack for decreasing the response time in situations wherein the hydraulic jack has cavitated and no positive load pressure signal is present.

7 Claims, 1 Drawing Figure

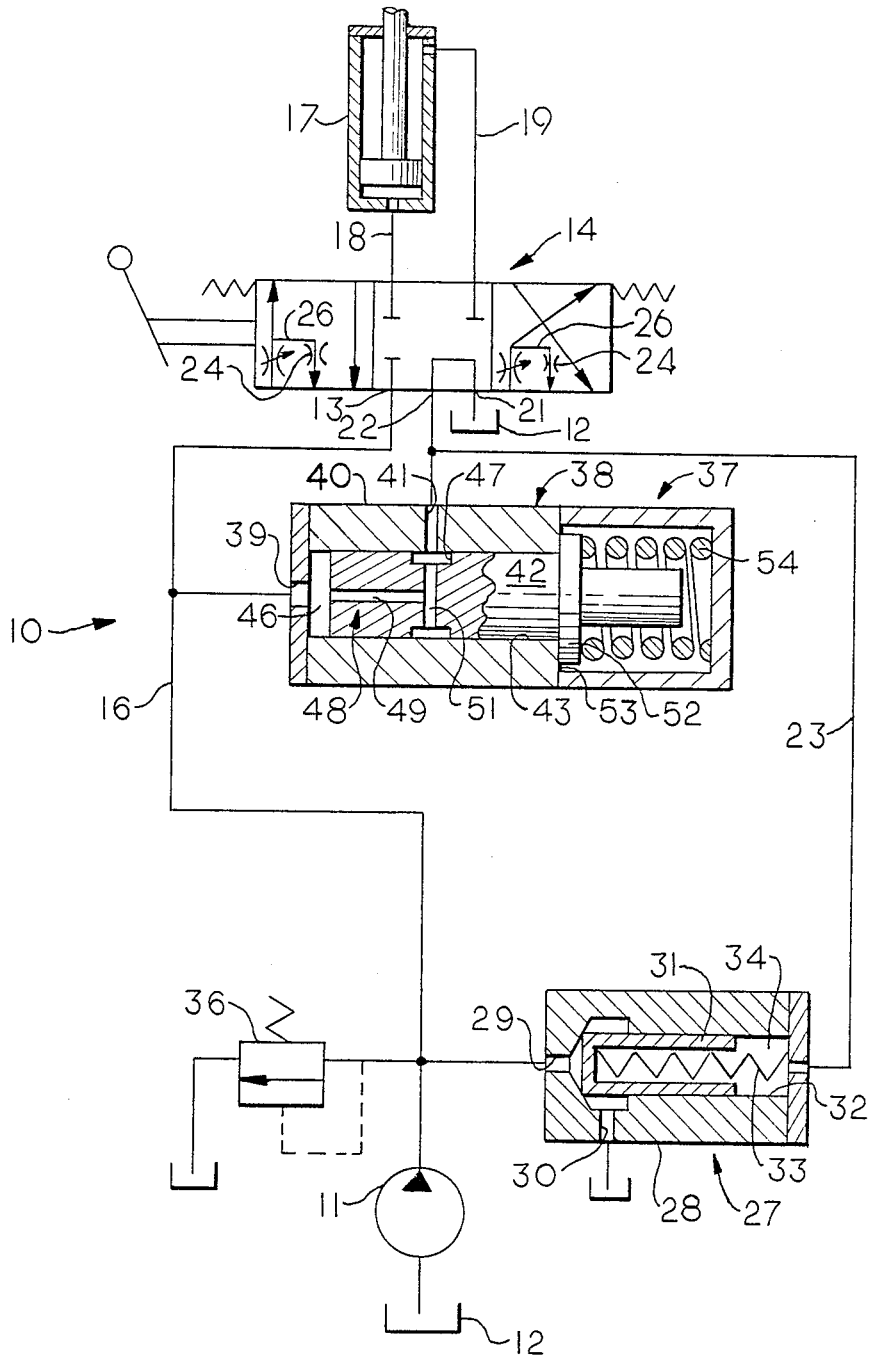
17
19
18
14
26
26
24
24
13
22
21
12
40
41
47
38
37
39
42
54
10
46
16
48
49
51
43
53
52
23
31
34
36
29
32
30
33
11
28
27
12

SIGNAL VALVE FOR PRESSURE COMPENSATED SYSTEM

TECHNICAL FIELD

This invention relates generally to a pressure compensated hydraulic system and more particularly to a signal valve for directing an artificial load signal to the load signal chamber of an unloading valve.

BACKGROUND ART

Some hydraulic systems use a pressure compensated unloading valve to dump the discharge fluid flow from a fixed displacement pump directly to tank when the control valve is in neutral. The unloading valve also maintains pump discharge pressure at a preselected level above the load pressure when one of the control valves is actuated. The unloading valve is shifted to the blocking or pressure compensation position by a positive load signal directed to the load signal chamber thereof from the control valve. One of the problems encountered with such systems is that of slow response of the hydraulic system during at least one operating condition wherein a positive load signal is not present to load up the unloading valve such that it does not move to the fluid blocking position. One such condition exists when a control valve connected to a load supporting hydraulic jack is shifted to lower the load i.e. lower a bucket of a loader. Under the influence of the load, the fluid is forced out of the load supporting end of the hydraulic jack faster than the fluid is directed to the other end such that the unloaded end of the hydraulic jack tends to cavitate. Thus, when the bucket reaches the ground, there is no positive load signal being directed to the unloading valve and its remains in a dump mode so that only a small amount of fluid from the pump is being directed the cavitated end of the hydraulic jack. This causes an undesirable delay or lag in the response time when the control valve is maintained in a position for applying a downward force to the bucket.

The present invention is directed to overcoming the problem as set forth above.

DISCLOSURE OF THE INVENTION

In one aspect of the present invention, a hydraulic system has a pump, a supply conduit connected to the pump, and a control valve connected to the supply conduit and to a hydraulic motor. The control valve is movable between a neutral position at which the hydraulic motor is isolated from the supply conduit and an operating position at which fluid from the supply conduit is directed to the hydraulic motor. A fluid responsive means has a load signal chamber therein and is effective to control the fluid flow through the supply conduit in response to the pressure level of a load signal directed to the signal chamber. A valve means is responsive to the fluid pressure in the supply conduit for directing an artificial load signal to the load signal chamber of the fluid responsive means when the control valve is at the operating position and the fluid pressure in the supply conduit is below a preselected level.

The present invention provides a valve means for providing a faster response of a pressure compensated hydraulic system used for lowering a bucket of a loader or other similar implement. The valve means provides a faster response by directing an artificial load signal to the load signal chamber of a pressure responsive valve when the control valve is in an operating position and the fluid pressure in the supply conduit is below a preselected value. This artificial load signal causes the pressure responsive valve to shift to a fluid blocking condition so that substantially full pump flow is directed to the hydraulic jack even if no positive load signal is present at the hydraulic jack.

BRIEF DESCRIPTION OF THE DRAWING

The sole FIGURE is a schematic circuit of an embodiment of the present invention with portions shown in cross section for illustrative convenience.

BEST MODE FOR CARRYING OUT THE INVENTION

Referring now to the drawing, a pressure compensated hydraulic system is generally indicated by the reference numeral 10 and includes a fixed displacement pump 11 connected to a tank 12. The pump 11 is connected to an inlet port 13 of a directional control valve 14 by a supply conduit 16. The control valve 14 is connected to a load supporting hydraulic jack 17 through a pair of conduits 18,19 and has a tank port 21 connected to the tank 12 and a signal port 22 connected to a signal line 23. An orifice 24 is provided in a load signal flow path 26 formed in the control valve 14. The control valve 14 can be either manually or pilot operated in the usual manner.

A fluid responsive means, for example, a pressure compensated unloader valve 27 has a body 28. The body 28 has an inlet port 29 connected to the supply conduit 16 and an outlet port 30 connected to the tank 12. A valve member 31 is slidably positioned in a bore 32 in the body 28 and is biased to a blocking position by a spring 33 positioned in a load signal chamber 34. The signal line 23 is connected to the load signal chamber 34.

A relief valve 36 is connected to the supply conduit 16 for limiting maximum pressure in the hydraulic system 10.

A valve means 37 responsive to the fluid pressure in the supply conduit 16 is provided for directing an artificial load signal to the load signal chamber 34 of the fluid responsive means when the control valve 14 is at an operating position and the fluid pressure in the supply conduit 16 is below a first preselected pressure level.

The valve means 37 can include a signal valve 38 having a body 40. The body 40 has an inlet port 39 connected to the supply conduit 16 and a signal port 41 connected to the signal line 23. A valve spool 42 is slidably positioned in a bore 43 of the valve body 40 and forms an actuating chamber 46 in the bore at one end thereof. The valve spool 42 has an annular groove 47 formed in its periphery and an internal passageway 48 which communicates the actuating chamber 46 with the annular groove 47. The passageway 48 includes an axially extending passage 49 and a transverse passage 51. A flange 52 is formed on the end of the spool opposite the actuating chamber 46 and is biased into abutment with a stop surface 53 of the body 44 by a spring 54 so that the annular groove 47 is normally aligned with the signal passage 41.

INDUSTRIAL APPLICABILITY

The hydraulic system of the present invention is particularly useful in industrial or earthmoving applications wherein the hydraulic jack is used to support a load such as a loader which has the lift arms supported by one or more hydraulic jacks. In operation, the control valve 14 is movable in either direction from the neutral position shown to first and second infinitely variable operating positions. At the neutral position, the supply conduit 16 is isolated from the conduits 18,19, and hence the hydraulic jack 17 and the signal port 22 is in communication with the tank 12. Moving the control valve 14 leftward to the first position communicates the supply conduit 16 with the conduit 19 for directing fluid to the rod end of the hydraulic jack 17 and simultaneously communicates the conduit 18 with the outlet port 21 and the tank 12. Moving the control valve 14 rightward to the second position communicates the inlet port 13 with the conduit 18 for directing fluid from the supply conduit 16 to the head end of the hydraulic jack 17 and simultaneously communicates the conduit 19 with the outlet port 21 and the tank 12. At both the first and second positions, the load signal flow path 26 is in communication with one of the conduits 18 or 19 and the signal port 22.

The valve member 31 of the pressure compensated unloader valve 27 is movable between a blocking position at which the inlet port 29 is blocked from the outlet port 30 and an open position at which the inlet port 29 is in communication with the outlet port 30. The valve spool 42 of the load signal valve is movable between an open position at which the annular groove 47 is in communication with the signal port 41 for passing fluid from the inlet port 39 to the signal port and a blocking position at which the annular groove is blocked from communication with the signal port for blocking fluid flow from the inlet port to the signal port.

At the neutral position of the control valve 14, the load signal chamber 34 is vented to the tank through the signal line 23 and load signal port 22. Thus, the fluid entering the unloader valve 27 through the inlet port 29 from the supply conduit 16 moves the valve member 31 only against the biasing force of the spring 33 such that the unloader valve 27 unloads the output of the pump to the tank 12 at a second relatively low preselected pressure level which is less than the first preselected pressure level. When the control valve 14 is moved to one of its operating positions, a load signal essentially equivalent to the load pressure in one of the conduits 18 or 19 is directed through the load signal line 23 to the actuating chamber 34. Under most operating conditions, a positive load pressure is established in the appropriate conduit 18 or 19 resulting in a positive load signal being directed to the load signal chamber 34. This positive load signal in the load signal chamber 34 is additive to the biasing force of the spring 33 and loads up the valve member 31 to move it towards the blocking position with the net effect being that the fluid pressure in the supply conduit 16 is immediately increased to maintain a preselected pressure differential between the supply conduit 16 and the appropriate conduit 18 or 19. Such pressure increase in the supply conduit is transmitted through the inlet port 39 and into the actuating chamber 46 of the load signal valve 38. When such pressure in the actuating chamber 46 exceeds the first preselected pressure level, the valve spool 42 is moved to the blocking position.

Under some operating conditions such as when the hydraulic jack 17 is retracted rapidly under the influence of the load, the rod end may cavitate such that there will not be a positive load signal in conduit 19 and hence the load signal chamber 34. However, when this condition exists, the pressure in the supply conduit will be below the first preselected level such that the valve spool 42 will be at the open position. Thus a portion of the fluid in the supply conduit 16 passes through the passageway 48, annular groove 47 and outlet passage 41 of the signal valve 38 and into the load signal line 23 as an artificial load signal. The orifice 24 restricts fluid flow through the load signal flow path 26 thereby resulting in a positive artificial load pressure signal being directed to the load signal chamber 34 of the unloader valve 27. Such artificial load signal moves the valve member 31 to the blocking position so that essentially full pump discharge flow is directed to the cavitated rod end of the hydraulic jack. With full pump discharge flow being directed to the rod end, the void fills quickly thereby establishing a positive load pressure which is then directed to the load signal chamber 34. As previously described, when the fluid pressure in the supply conduit 16 exceeds the first preselected pressure level, the valve spool 42 is moved to the blocking position such that the unloader valve 27 then functions in response to the load pressure signal in the normal manner.

In view of the foregoing, it is readily apparent that the structure of the present invention provides an improved pressure compensated hydraulic system by providing therein a signal valve which provides an artificial load pressure signal for pressurizing the load signal chamber of a pressure compensated unloader valve when the control valve is in an operating position and the pump discharge pressure is below a preselected level. By artificially loading up the unloader valve, a faster response is achieved when the control valve is actuated after a heavy load has been lowered at a speed sufficient to cause cavitation in the hydraulic jack.

Other aspects, objects and advantages of this invention can be obtained from a study of the drawing, the disclosure and the appended claims.

I claim:

1. In a hydraulic system (10) having a tank (12), a pump (11), a supply conduit (16) connected to the pump, a control valve (14) connected to the supply conduit (16) and to a hydraulic jack (17), said control valve (14) being movable between a neutral position at which the hydraulic jack (17) is isolated from the supply conduit (16) and an operating position at which fluid from the supply conduit (16) is directed to the hydraulic jack, fluid repsonsive means (27) having a signal chamber (34) therein and being effective to control the fluid flow through the supply conduit (16) in response to the pressure level of a load pressure signal directed to the signal chamber (34), and a signal line (23) connected to the control valve and to the signal chamber (34) of the fluid responsive means for directing a load pressure signal to the signal chamber at the operating position of the control valve, the improvement comprising:

valve means (37) repsonsive to the fluid pressure in the supply conduit (16) for directing an artificial load signal to the signal chamber (34) of the fluid responsive means (27) when the control valve (14) is at the operating position and the fluid pressure in the supply conduit (16) is below a preselected level.

2. The hydraulic system as set forth in claim 1 wherein said valve means (37) includes a signal valve (38) having an inlet port (39) connected to the supply conduit (16) and a signal port (41) connected to the load signal chamber (34) of the fluid responsive means (27).

3. The hydraulic system as set forth in claim 2 wherein said signal valve (38) includes a valve spool (42) movable from an open position at which said signal port (41) is in communication with the inlet port (39)

and a blocking position at which the signal port (41) is blocked from the inlet port (39).

4. The hydraulic system as set forth in claim 3 wherein said signal valve (38) includes a spring (54) biasing the valve spool (42) to the open position, said valve spool (42) being moved to the blocking position in response to the fluid pressure in the supply conduit (16) exceeding said preselected level.

5. The hydraulic system (10) as set forth in claim 4 wherein said signal port (41) of said signal valve (38) is connected to the signal line.

6. The hydraulic system as set forth in claim 1 wherein said control valve includes a load signal flow path (26) communicating the load pressure signal from the hydraulic jack to the signal line at the operating position of the control valve, said load signal flow path (26) having an orifice (24) disposed therein.

7. The hydraulic system as set forth in claim 1 wherein said fluid responsive means (37) includes a pressure compensated unloader valve (37) having an inlet port (29) connected to the supply conduit (16) and a valve member (31) movable between a blocking position at which said inlet port (29) is blocked from the tank (12) and an open position at which said inlet port (29) is in communication with the tank.

* * * * *